US011691240B1

(12) United States Patent
Bow et al.

(10) Patent No.: US 11,691,240 B1
(45) Date of Patent: Jul. 4, 2023

(54) FRICTION POLISHING DEVICE FOR POLYMER FILAMENT

(71) Applicant: Team Technologies, Inc., Morristown, TN (US)

(72) Inventors: Clark Bow, Dandridge, TN (US); Wesley Parker, Russellville, TN (US)

(73) Assignee: Team Technologies, Inc., Morristown, TN (US)

( * ) Notice: Subject to any disclaimer, the term of this patent is extended or adjusted under 35 U.S.C. 154(b) by 1,076 days.

(21) Appl. No.: 16/388,196

(22) Filed: Apr. 18, 2019

(51) Int. Cl.
*B24B 9/20* (2006.01)
*B24D 11/00* (2006.01)

(52) U.S. Cl.
CPC ... *B24B 9/20* (2013.01); *B24D 11/00* (2013.01)

(58) Field of Classification Search
None
See application file for complete search history.

(56) References Cited

U.S. PATENT DOCUMENTS 5,431,596 A * 7/1995 Akita et al. ..... B24D 7/08 451/540
7,374,474 B2* 5/2008 Nishiyama et al. .... B24B 37/22 257/E21.244

FOREIGN PATENT DOCUMENTS

CN 2337837 Y * 9/1999
EP 443550 A * 8/1991 .....F16D 69/026
WO 2010021138 A1* 2/2010 .....A46D 1/05

* cited by examiner

*Primary Examiner* — Pegah Parvini
*Assistant Examiner* — Ross J Christie
(74) *Attorney, Agent, or Firm* — Luedeka Neely Group, P.C.

(57) ABSTRACT

A polishing device for polishing bristles includes a grinding surface and a friction material thereon, the friction material having aramid fibers or pulp bonded with a polyimide resin.

5 Claims, 4 Drawing Sheets

FRICTION POLISHING DEVICE FOR POLYMER FILAMENT

FIELD

This disclosure relates to the field of brushes. More particularly, this disclosure relates to devices for use in the polishing and finishing of plastic filaments used in making bristles for brushes.

BACKGROUND

Improvement is desired in the manufacture of brushes having bristles made of plastic filaments to remove sharp edges and the like from the filaments. For most uses, having sharp edges is highly undesirable, and particularly in the manufacture of toothbrushes.

Filaments used to make toothbrushes are typically made of plastics such as polyamide and/or polyester. Such a filament is produced through an extrusion molding process that yields long, continuous fibers, usually with a cylindrical cross section. The diameter of the individual fibers used to produce toothbrushes is normally in the range of 0.004" (0.100 mm) to 0.009" (0.230 mm). The filament is collated into bundles of multiple strands and cut to a suitable length for insertion into holes in a toothbrush handle. Typically, the entire field of bristles is cut again after insertion into the handle to achieve a uniform contour for the bristle tips. The process of cutting the fiber results in plain cut ends that have sharp edges.

Conventionally, it is common to treat the bristles by mechanical abrasion to remove sharp edges from the free ends of the individual filaments by rounding off the sharp cut edges, commonly called end rounding. End rounding may be accomplished by grinding material off of the bristle tips using a series of fine grit abrasive wheels. An example of a conventional Prior Art grinding wheel is shown in FIG. 1. It has been observed that conventional grinding wheels, such as shown in FIG. 1, desire improvement in that the finish they provide to the bristles desires improvement. An example of Prior Art bristles finished using grinding wheels such as shown in FIG. 1 are shown in FIG. 2.

FIG. 2 depicts prior art bristles that have been polished with the prior art grinding wheel of FIG. 1 and undesirably have shreds of ground plastic material remaining attached to the filaments and a generally scratched appearance. It has been observed that use of the grinding wheel of FIG. 1 results in an incomplete polishing that yields an undesirable scratched and rough surface, with some plastic material being ground to a consistency that is too flexible to offer enough resistance to the grinding wheel to generate sufficient force to break the bond to the filament resulting in the shreds. The size of the remaining shreds of plastic material is typically on the order of 5 to 25 microns in width and it remains attached to the sides and extreme ends of the individual filaments.

The present disclosure advantageously provides a polishing device that avoids shortcomings associated with the use of conventional devices, such as the grinding wheel of FIG. 1.

SUMMARY

The above and other needs are met by apparatus and methods for polishing bristles, and, in particular, In one aspect, a polishing device for polishing bristles includes a grinding surface and a friction material thereon, the friction material having aramid fibers or pulp bonded with a polyimide resin.

In another aspect, a method for polishing and finishing plastic brush bristles includes the steps of: (1) providing a polishing device having a polishing surface comprising an aramid containing material; and (2) rotating the polishing device against tips of the brush bristles to partially or fully radius the tips of the brush bristles, wherein the tips of the brush bristles are substantially devoid of shreds of ground plastic remaining attached to the bristles.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 3:
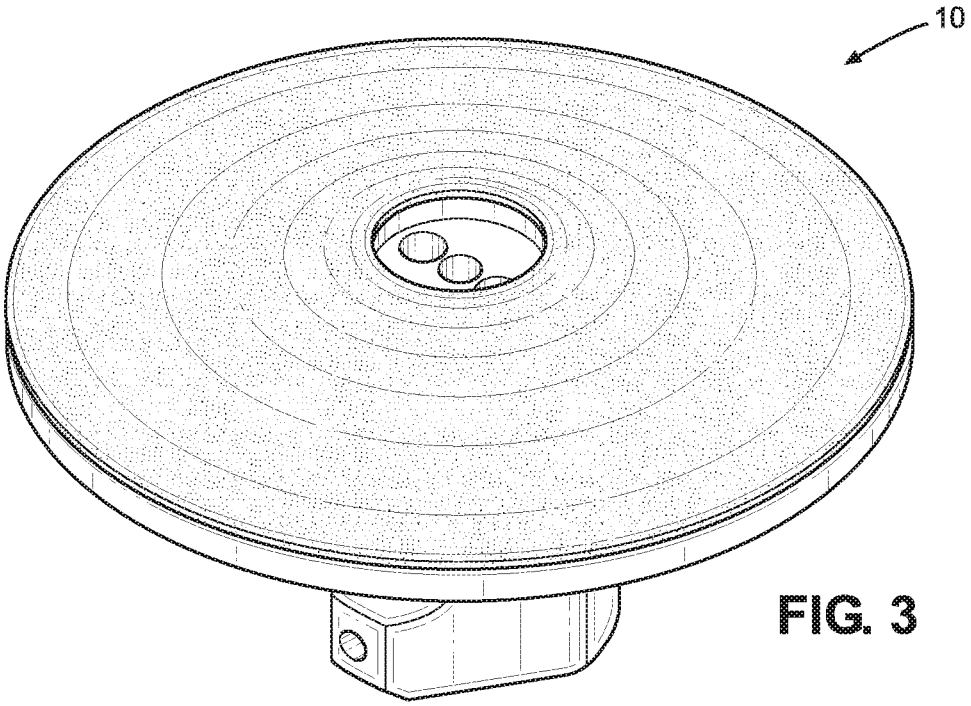
FIG. 3 shows a polishing device according to the disclosure.
Figure 4:
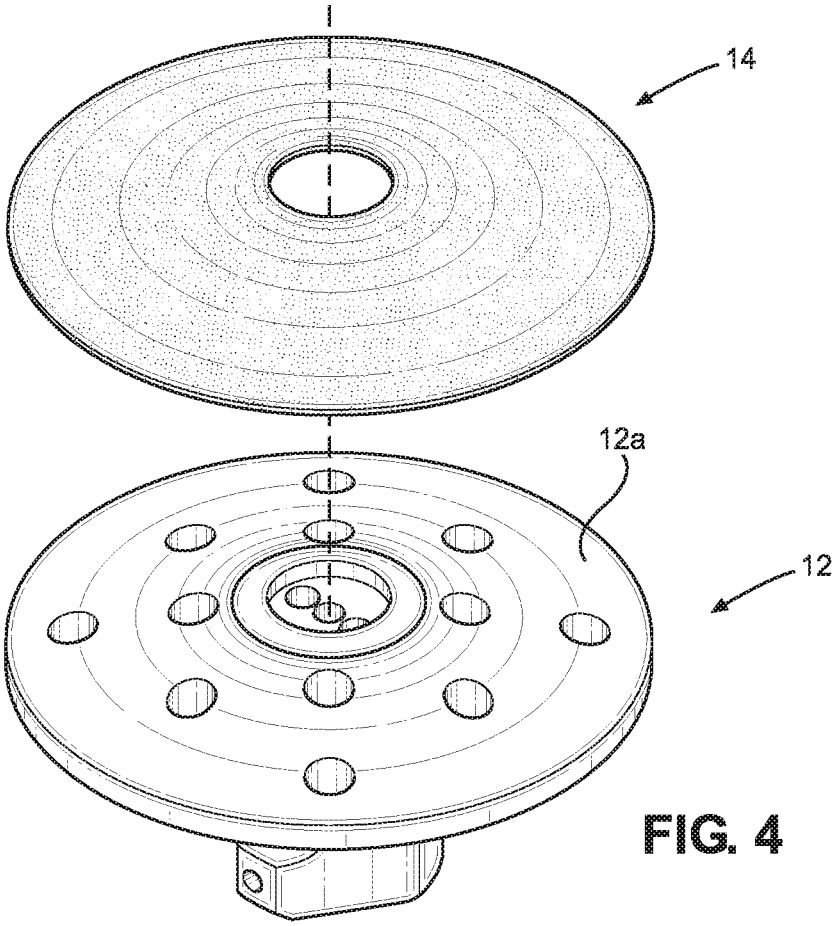
FIG. 4 is an exploded view of the polishing device of FIG. 3.

With initial reference to FIGS. 3-4, there is shown a polishing device 10 according to the disclosure. The polishing device 10 includes a grinding wheel 12 having on an exterior surface thereof a friction material 14 having a high dynamic coefficient of friction relative to the plastic or polymer material of filaments to be polished.

Figure 5:
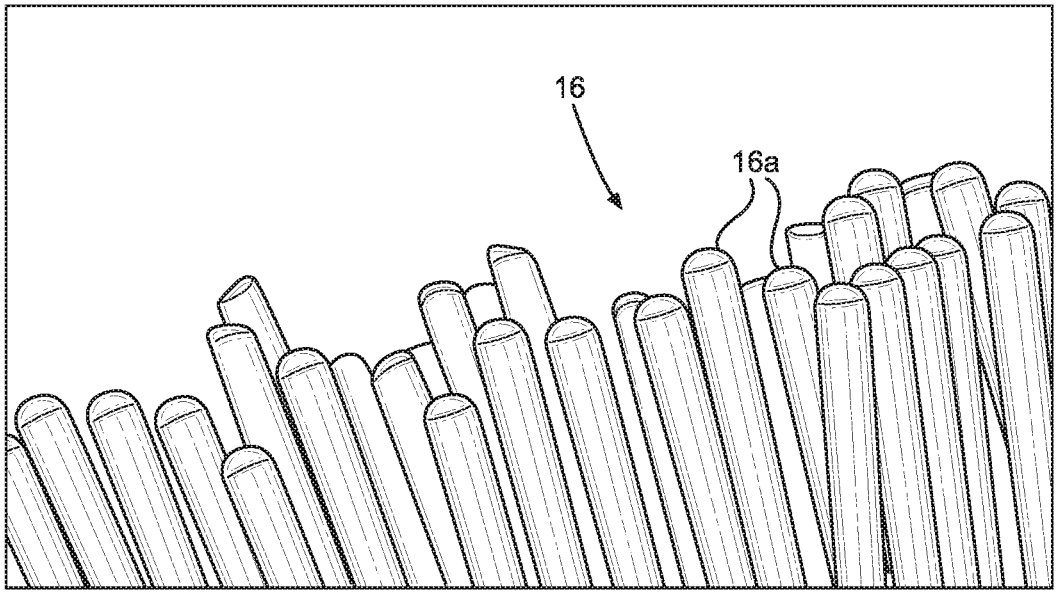
FIG. 5 is a magnified view of toothbrush bristles polished using a polishing device according to the disclosure.

Use of the polishing device 10 to polish bristles results in a desired polishing of toothbrush bristles 16 as shown in FIG. 5, discussed more fully below. In this regard, the polishing device 10 is particularly configured for polishing and finishing of synthetic brush fibers made of extruded polyamide or polyester filament in the size range of from about 0.003 to about 0.018 inches, which are typically used for toothbrush bristles.

Figure 1:
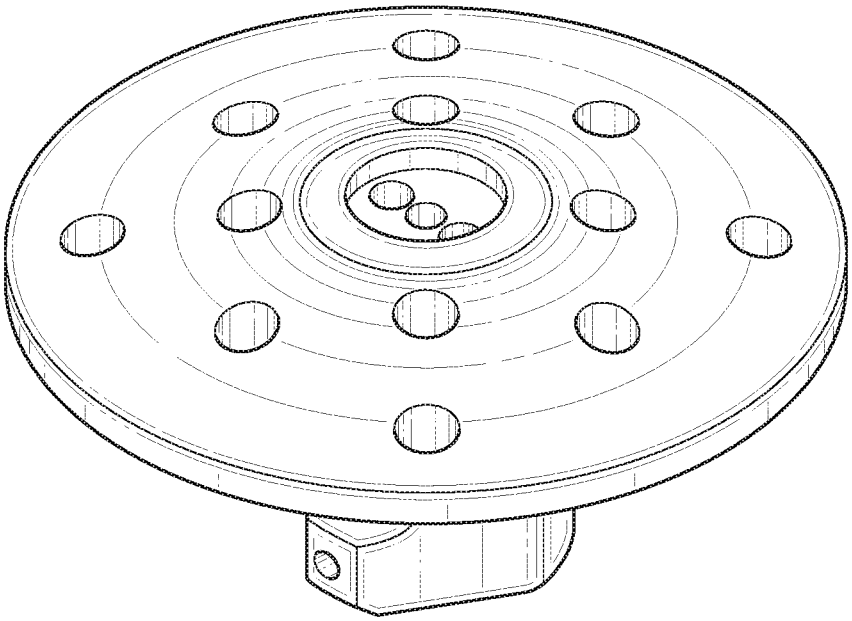
FIG. 1 PRIOR ART
FIG. 1 shows a prior art polishing device.
Figure 6:
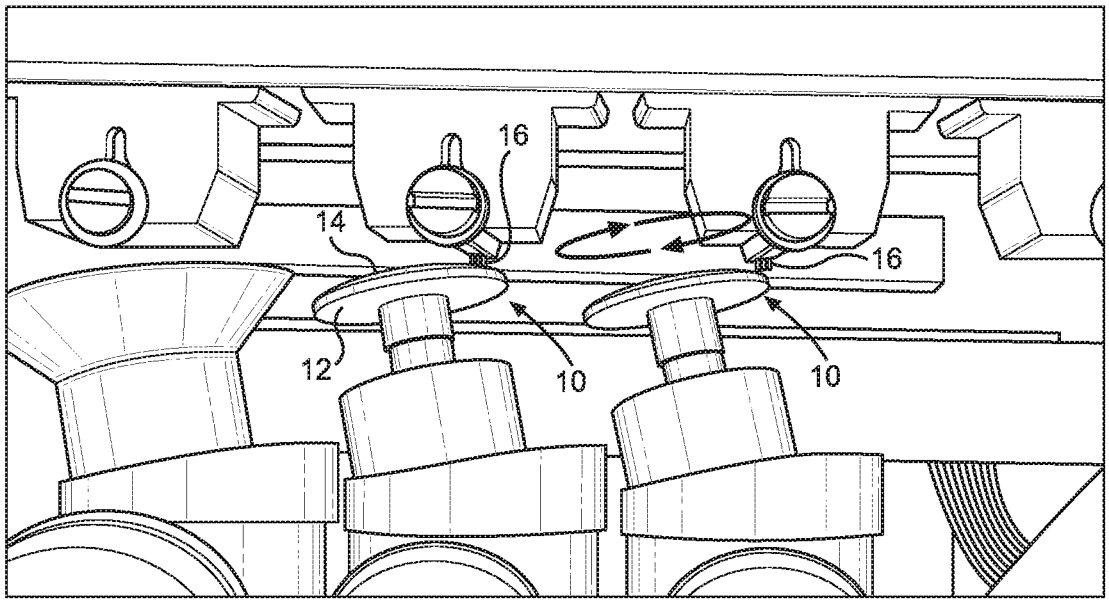
FIGS. 6 and 7 depict a desired polishing motion used with the polishing device of FIG. 3.
Figure 7:
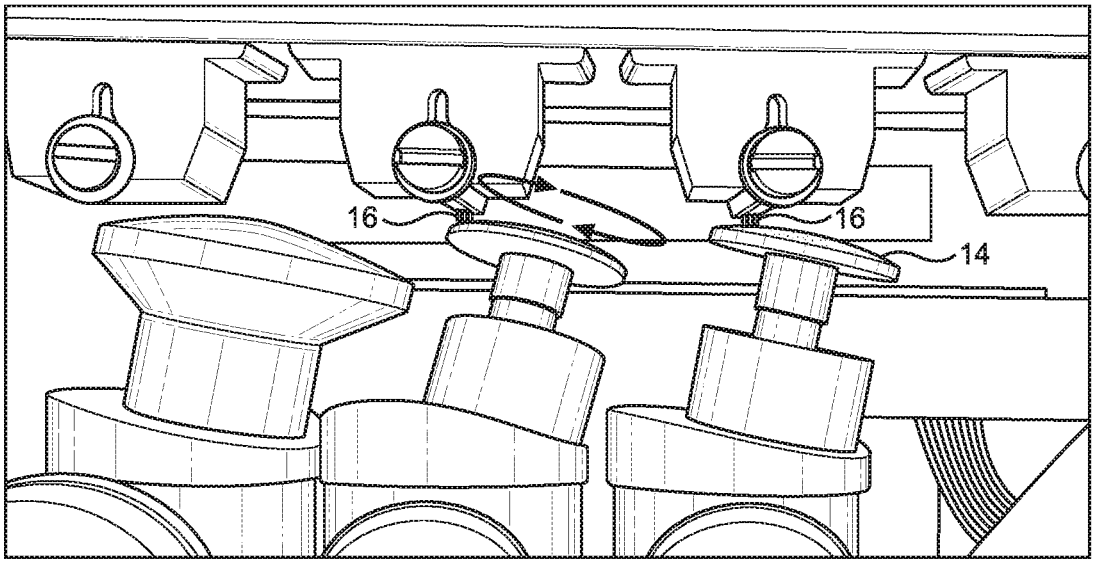

The grinding wheel 12 may be a conventional grinding wheel such as the prior art grinding wheel as shown in FIG. 1 having a conical surface 12*a*. The wheel 12 and the surface 12*a* are desirably made of aluminum or steel. The wheel 12 may be attached to a drive shaft of a polishing machine operated to impart rotary and oscillating motion to the head, such as shown in FIGS. 6 and 7.

The friction material 14 is provided by aramid fibers or pulp bonded with a high temperature polyimide resin to provide a sheet material having a thickness of from about 0.060 to about 0.080 inches. Preferred aramid fibers or pulps are available under the name K-29 from E. I. du Pont de Nemours and Company, Wilmington, DE, which have a density of about 1.44 g/cm3, a coefficient of friction of about 0.36 mu, and a static to dynamic friction ratio of about 1.05:1. Preferred sheet materials having the K-29 aramid fibers bonded with a high temperature polyimide resin are available as clutch liner and brake pad materials from E. I. du Pont de Nemours and Company, Wilmington, DE, which have a density of about 0.91 g/cm3.

The friction material 14 is formed into a disk shape as shown in FIG. 4 configured to contour to the shape of the conical surface 12*a* when applied thereto. The friction material 14 may be bonded onto the conical surface 12*a* using an adhesive such as a 2-part epoxy. It will be appreciated also that the friction material 14 may otherwise be applied onto the conical surface 12*a*. For example, friction material 14 may be provided as a liquid coating that may be coated onto the conical surface 12*a* and cured or dried to render the friction material 14 bonded onto the conical surface.

Figure 2:
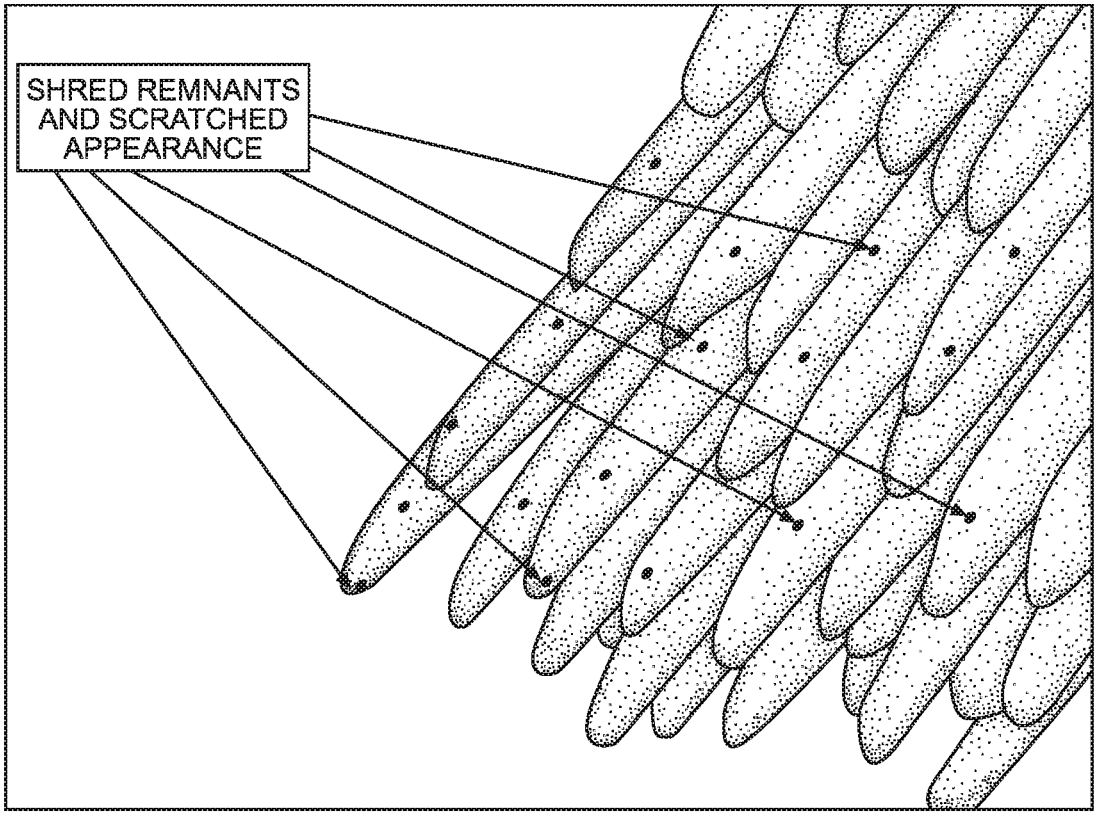
FIG. 2 PRIOR ART
FIG. 2 is a magnified view of toothbrush bristles polished in accordance with prior art polishing devices.

FIG. 5 shows the toothbrush bristles 16 polished using the polishing device 10 according to the disclosure. As will be observed, the bristles 16 of FIG. 5 do not have the shreds and scratches of the bristles shown in FIG. 2 polished using the prior art device of FIG. 1. It has been observed that the device 10 is particularly suitable for polishing and finishing of synthetic brush fibers made of extruded polyamide or polyester filament in the size range of from about 0.003 to about 0.018 inches, to partially or fully radius tips 16*a* of the bristles 16 with a radius in the range of from about 0.0015 to 0.0090 inches.

Without being bound by theory, it is believed that the polishing device 10 having the friction material 14 generates sufficient frictional force on the microscopic remnants of shredded polymer material of the bristles 16 to break the remaining connection to the bristles 16 so that shreds and other remnants are removed. It is also believed that the polishing device 10 advantageously generates sufficient heat and mechanical forces because of the friction material 14 to smooth out any microscopic scratches.

FIGS. 6 and 7 show a desired polishing motion to polish the bristles 16 using the polishing device 10. As seen, polishing devices 10 are connected to motorized drive shafts to revolve the conical surfaces 12*a* around their central axis, with the conical surface 12*a* oscillating around and offset and tilted in such a way that some portion of the conical surface 12*a*, having the friction material 14 thereon, remains substantially tangent to a plane corresponding to a plane of the tips 16*a* of the bristles 16.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A polishing system for polishing bristles having tips, the polishing system comprising: a polishing device provided by a rotatable, conical surface and a polishing surface provided by a friction material on the rotatable, conical surface configured for polishing the tips of the bristles to partially or fully radius the tips of the bristles with a radius in the range of from about 0.0015 to 0.0090 inches, the friction material consisting essentially of aramid fibers or pulp bonded with a polyimide resin, and having a coefficient of friction of about 0.36 mu, and a static to dynamic friction ratio of about 1.05.

2. The polishing system of claim 1, wherein the friction material is provided as a sheet material having a thickness of from about 0.060 to about 0.080 inches adhesively secured to the rotatable surface.

3. A method for polishing and finishing plastic brush bristles having tips, comprising the steps of: (1) providing a polishing device having a polishing surface consisting essentially of an aramid containing material; and (2) rotating the polishing device against the tips of the brush bristles to partially or fully radius the tips of the brush bristles with a radius in the range of from about 0.0015 to 0.0090 inches, wherein the polished and finished tips of the brush bristles are substantially devoid of shreds of ground plastic remaining attached to the bristles.

4. The method of claim 3, wherein the brush bristles are made of extruded polyamide or polyester filament in the size range of from about 0.003 to about 0.018 inches.

5. The method of claim 3, wherein the step of rotating the polishing device against the tips of the bristles comprises oscillating the polishing device around the tips of the bristles with the polishing device tilted relative to the bristles such that a portion of the friction material remains substantially tangent to a plane corresponding to a plane of the tips of the bristles.

* * * * *